US008195066B2

(12) United States Patent
Tanaka

(10) Patent No.: US 8,195,066 B2
(45) Date of Patent: Jun. 5, 2012

(54) IMAGE FORMING APPARATUS AND TONER SUPPLYING APPARATUS

(75) Inventor: Yoshiaki Tanaka, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 783 days.

(21) Appl. No.: 12/209,018

(22) Filed: Sep. 11, 2008

(65) Prior Publication Data

US 2009/0074465 A1 Mar. 19, 2009

Related U.S. Application Data

(60) Provisional application No. 60/972,218, filed on Sep. 13, 2007.

(51) Int. Cl.
*G03G 21/18* (2006.01)

(52) U.S. Cl. ..... 399/113; 399/258

(58) Field of Classification Search ..... 399/110, 399/111, 113, 119, 121, 256, 258
See application file for complete search history.

(56) References Cited

FOREIGN PATENT DOCUMENTS

JP 11-024513 1/1999

*Primary Examiner* — David Gray
*Assistant Examiner* — Barnabas Fekete
(74) *Attorney, Agent, or Firm* — Patterson & Sheridan, LLP

(57) ABSTRACT

An image forming apparatus includes plural developing devices, plural toner cartridges, and plural sub-hoppers that receive toners stored in the respective toner cartridges and supply the toners to the respective developing devices. The plural sub-hoppers are coupled by a coupling member. The coupled plural sub-hoppers are detachably held between the toner cartridges and the developing devices.

14 Claims, 9 Drawing Sheets

IMAGE FORMING APPARATUS AND TONER SUPPLYING APPARATUS

CROSS-REFERENCE TO RELATED APPLICATION

This application is based upon and claims the benefit of U.S. Provisional Application No. 60/972,218, filed Sep. 13, 2007, the entire contents of which are incorporated herein by reference.

TECHNICAL FIELD

The present invention relates to an image forming apparatus of an electrophotographic system that superimposes toners of plural colors to obtain a color image, a toner supplying apparatus, and a toner supplying method.

BACKGROUND

In general, in an image forming apparatus of an electrophotographic system, plural photoconductive drums are arranged in parallel and laser beams are irradiated on the respective photoconductive drums to form electrostatic latent images. Toner images of respective colors are formed on the photoconductive drums by developing devices. The toner images of the respective colors are multiply transferred onto a sheet to obtain a color image.

The developing devices are provided in the plural photoconductive drums, respectively. Plural toner cartridges for supplying toners to the developing devices are attached to carry the toners stored in the toner cartridges to the developing devices.

Sub-tanks may be arranged between the toner cartridges and the developing devices. The sub-tanks are generally called sub-hoppers and are auxiliary toner tanks provided between the toner cartridges and the developing devices. Since the toners in the toner cartridges are supplied to the sub-hoppers, it is possible to perform printing using the toners in the sub-hoppers even if the toners in the toner cartridges are exhausted.

JP-A-11-24513 discloses a toner supplying apparatus. In an example of the structure disclosed in JP-A-11-24513, sub-hoppers are arranged between toner cartridges and developing devices.

In the image forming apparatus in the past, it is necessary to feed developers into the developing devices when the image forming apparatus is set up. During the setup, the toner cartridges are replaced with toner cartridges containing the developers to supply the developers to the developing devices. Therefore, work for feeding the developers during the setup is complicated.

The toner cartridges tend to have larger capacities. It is evident that toner quantities in the toner cartridges are large compared with necessary quantities of the developers. When the developers are stored in the toner cartridges, developer cartridges increased in size have to be used.

When the sub-hoppers are replaced, since there are the plural sub-hoppers, it is likely that the respective sub-hoppers are mounted in wrong positions.

SUMMARY

According to an aspect of the present invention, there is provided an image forming apparatus including:

plural developing devices that develop electrostatic latent images formed on image bearing members;

plural toner cartridges in which toners to be supplied to the plural developing devices are stored;

plural sub-hoppers that receive the toners stored in the plural toner cartridges and supply the toners to the plural developing devices;

a coupling member that couples the plural sub-hoppers; and a holding member that is arranged between the toner cartridges and the developing devices and detachably holds the plural sub-hoppers coupled by the coupling member.

DETAILED DESCRIPTION

Figure 1:
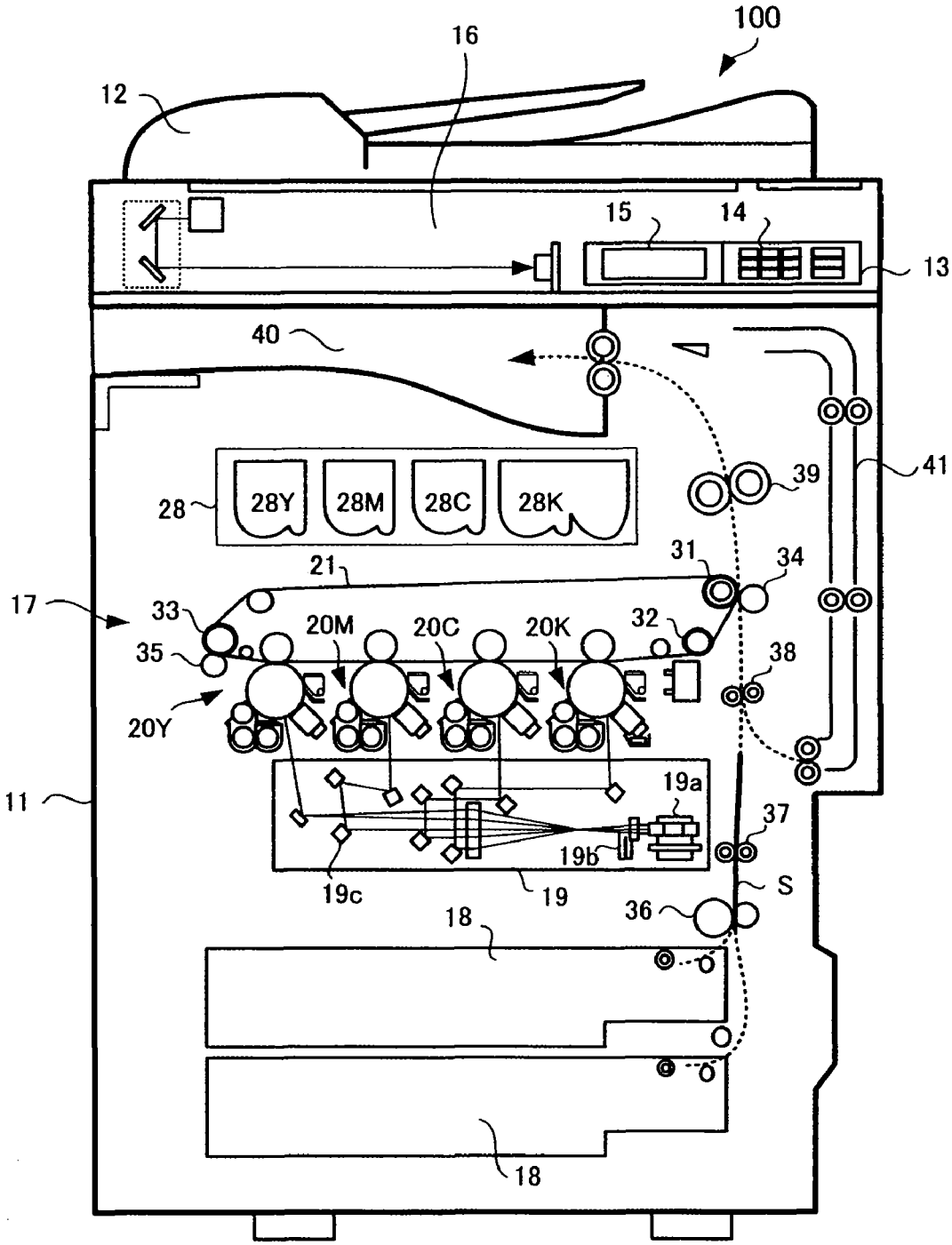
FIG. 1 is a front view of an image forming apparatus according to an embodiment.

Throughout this description, the embodiment and example shown should be considered exemplars, rather than limitations on the apparatus of the present invention.

An image forming apparatus according to an embodiment is explained in detail below with reference to the accompanying drawings. In the respective drawings, the same components are denoted by the same reference numerals and signs.

FIG. 1 is a diagram showing the image forming apparatus according to the embodiment. In FIG. 1, reference numeral 100 denotes an image forming apparatus. The image forming apparatus 100 is, for example, an MFP (multi-function peripheral) as a complex machine, a printer, or a copying machine. In the following explanation, the MFP is explained as an example of the image forming apparatus 100.

A document table (not shown) is provided in an upper part of a main body 11 of the MFP 100. An automatic document feeder (ADF) 12 is openably and closably provided on the document table. An operation panel 13 is provided in an upper part of the main body 11. The operation panel 13 has an operation unit 14 including various keys and a display unit 15 of a touch panel type.

A scanner unit 16 is provided below the ADF 12 in the main body 11. The scanner unit 16 scans a document fed by the ADF 12 or a document placed on the document table and generates image data. A printer unit 17 is provided in the center in the main body 11. Plural cassettes 18 that store sheets of various sizes are provided in a lower part of the main body 11.

The printer unit 17 includes photoconductive drums and lasers (details of which are described later). The printer unit 17 processes image data scanned by the scanner unit 16 and image data created by a PC (personal computer) or the like and forms an image on a sheet.

The sheet having the image formed thereon by the printer unit 17 is discharged to a paper discharge unit 40. The printer unit 17 includes, for example, a tandem color laser printer. The printer unit 17 scans photoconductive members with a laser beam from a laser exposing device 19 and generates an image.

The printer unit 17 includes image forming units 20Y, 20M, 20C, and 20K for respective colors of yellow (Y), magenta (M), cyan (C), and black (K). The image forming units 20Y, 20M, 20C, and 20K are arranged in parallel below an intermediate transfer belt 21 from an upstream side to a downstream side.

Since the image forming units 20Y, 20M, 20C, and 20K have the same configuration, the image forming unit 20Y is explained below as a representative image forming unit. The printer unit 17 including the image forming units 20Y, 20M, 20C, and 20K is shown in FIG. 2 in enlargement.

Figure 2:
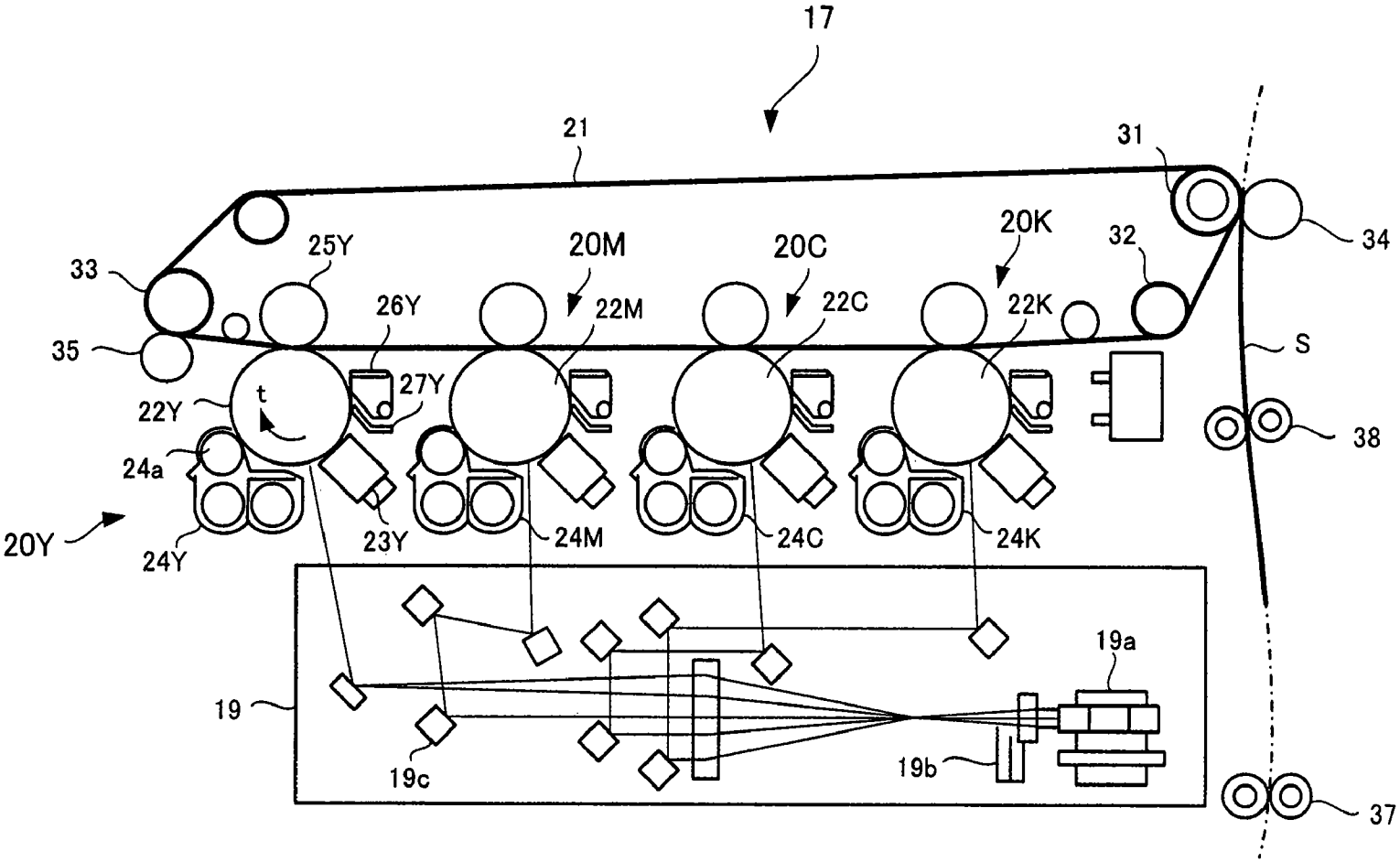
FIG. 2 is a diagram of an internal structure of the image forming apparatus shown in FIG. 1.

As it is seen from FIG. 2, the image forming unit 20Y has a photoconductive drum 22Y as an image bearing member. An electrifying charger 23Y, a developing device 24Y, a primary transfer roller 25Y, a cleaner 26Y, a blade 27Y, and the like are arranged around the photoconductive drum 22Y along a rotating direction t of the photoconductive drum 22Y. A yellow laser beam from the laser exposing device 19 is irradiated on an exposing position of the photoconductive drum 22Y to form a latent image on the photoconductive drum 22Y.

The electrifying charger 23Y of the image forming unit 20Y uniformly charges the entire surface of the photoconductive drum 22Y. The developing device 24Y supplies a two-component developer including a yellow toner and a carrier to the photoconductive drum 22Y using a developing roller 24*a* to which a developing bias is applied. The cleaner 26Y removes a residual toner on the surface of the photoconductive drum 22Y using the blade 27Y.

Toner cartridges 28 (FIG. 1) that supply toners to the developing devices 24Y to 24K are provided above the image forming units 20Y to 20K. The toner cartridges 28 include toner cartridges 28Y, 28M, 28C, and 28K for the respective colors of yellow (Y), magenta (M), cyan (C), and black (K).

Sub-hoppers are provided between the toner cartridges 28Y, 28M, 28C, and 28K and the developing devices 24Y, 24M, 24C, and 24K, respectively. The sub-hoppers are not shown in FIGS. 1 and 2. A toner supplying apparatus that uses the sub-hoppers is described later with reference to FIG. 3 and subsequent figures.

The intermediate transfer belt 21 circulatingly moves. For example, semi-conductive polyimide is used for the intermediate transfer belt 21 from the viewpoint of heat resistance and abrasion resistance. The intermediate transfer belt 21 is looped around a driving roller 31 and driven rollers 32 and 33 and is opposed to and in contact with the photoconductive drums 22Y to 22K. A primary transfer voltage is applied to a position of the intermediate transfer belt 21 opposed to the photoconductive drum 22Y by the primary transfer roller 25Y to primarily transfer a toner image on the photoconductive drum 22Y onto the intermediate transfer belt 21.

A secondary transfer roller 34 is arranged to be opposed to the driving roller 31 around which the intermediate transfer belt 21 is looped. When a sheet S passes between the driving roller 31 and the secondary transfer roller 34, a secondary transfer voltage is applied to the sheet S by the secondary transfer roller 34 to secondarily transfer the toner image on the intermediate transfer belt 21 onto the sheet S. A belt cleaner 35 is provided near the driven roller 33 of the intermediate transfer belt 21.

On the other hand, the laser exposing device 19 scans a laser beam emitted from a semiconductor laser element in an axial direction of the photoconductive drum 22. The laser exposing device 19 includes a polygon mirror 19*a*, a focusing lens system 19*b*, and a mirror 19*c*.

As shown in FIG. 1, a separation roller 36 that extracts the sheet S in the paper feeding cassettes 18, conveying rollers 37, and registration rollers 38 are provided between the paper feeding cassettes 18 and the secondary transfer roller 34. A fixing device 39 is provided downstream of the secondary transfer roller 34.

A paper discharging unit 40 is also provided downstream of the fixing device 39. A reverse conveying path 41 is also provided in the main body 11. The reverse conveying path 41 reverses the sheet S and guides the sheet S in a direction of the secondary transfer roller 34. The reverse conveying path 41 is used when duplex printing is performed. Since the reverse conveying path 41 is not the point of the present invention, detailed explanation thereof is omitted.

Operations of the image forming apparatus 100 shown in FIGS. 1 and 2 are explained. When image data is input from the scanner unit 16, the PC, or the like, images are sequentially formed in the image forming units 20Y to 20K.

The image forming unit 20Y is explained as an example. A laser beam corresponding to image data of yellow (Y) is irradiated on the photoconductive drum 22Y and an electrostatic latent image is formed thereon. The electrostatic latent image on the photoconductive drum 22Y is developed by the developing device 24Y and a yellow (Y) toner image is formed.

Subsequently, the photoconductive drum 22Y comes into contact with the rotating intermediate transfer belt 21 and primarily transfers the yellow (Y) toner image onto the intermediate transfer belt 21 using the primary transfer roller 25Y. After the toner image is primarily transferred onto the intermediate transfer belt 21, a residual toner on the photoconductive drum 22Y is removed by the cleaner 26Y and the blade 27Y. The photoconductive drum 22Y is prepared for the next image formation.

In the same manner as the yellow (Y) toner image forming process, magenta (M), cyan (C), and black (K) toner images are formed by the image forming units 20M to 20K. The toner images are sequentially transferred onto an identical position where the yellow (Y) toner image is present on the intermediate transfer belt 21. In this way, the yellow (Y), magenta (M), cyan (C), and black (K) toner images are multiply transferred onto the intermediate transfer belt 21 to obtain a full-color toner image.

The intermediate transfer belt 21 secondarily transfers the full-color toner image onto the sheet S collectively using a transfer bias of the secondary transfer roller 34. In synchronization with the full-color toner image on the intermediate transfer belt 21 reaching the secondary transfer roller 34, the sheet S is fed from the paper feeding cassettes 18 to the secondary transfer roller 34. The sheet S having the toner image secondarily transferred thereon reaches the fixing device 39 and the toner image is fixed on the sheet S. The sheet S having the toner image fixed thereon is discharged to the paper discharging unit 40.

On the other hand, after the secondary transfer is finished, a residual toner on the intermediate transfer belt 21 is cleaned by the belt cleaner 35.

The toner supplying apparatus according to the embodiment is explained.

Figure 3:
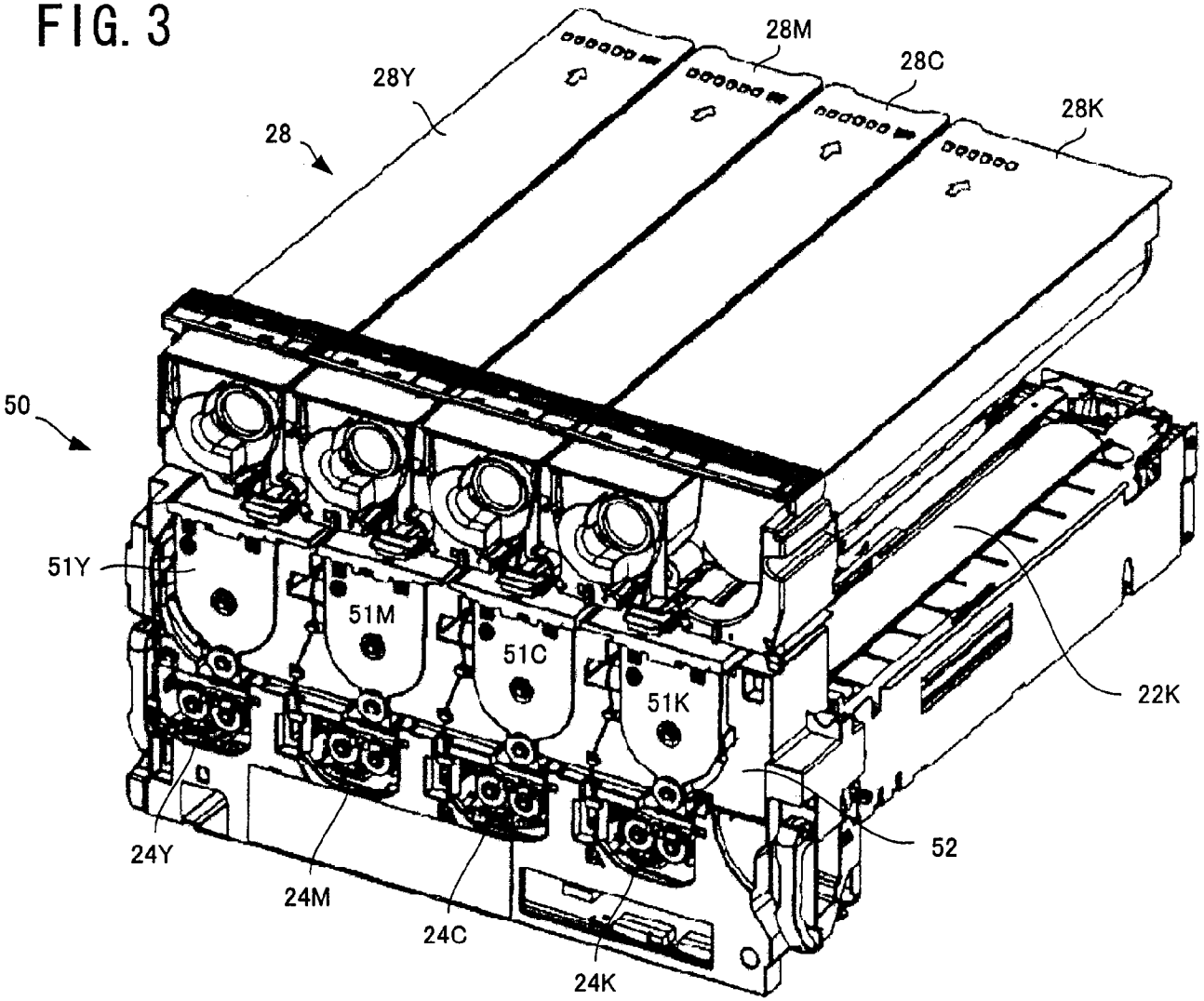
FIG. 3 is a perspective view showing a toner supplying apparatus provided in the image forming apparatus according to the embodiment.

FIG. 3 is a perspective view showing a configuration of a main part of a toner supplying apparatus 50. The toner supplying apparatus 50 includes sub-hoppers 51 provided between the toner cartridges 28 and the developing devices 24. In FIG. 3, the toner cartridges 28Y, 28M, 28C, and 28K for yellow (Y), magenta (M), cyan (C), and black (K) are provided in parallel in an upper stage and the developing devices 24Y, 24M, 24C, and 24K in parallel in a lower stage. Sub-hoppers 51Y, 51M, 51C, and 51K are attached in a middle stage between the toner cartridges 28 and the developing devices 24. In the figure, the intermediate transfer belt 21 and the primary transfer roller 25 are not shown.

In the figure, the four toner cartridges 28, the four developing devices 24, the four sub-hoppers 51, and the like are present in association with the respective colors of yellow (Y), magenta (M), cyan (C), and black (K). Therefore, the sings Y, M, C, and K are affixed thereto, respectively. However, in the following explanation, the signs Y, M, C, and K may be omitted.

The sub-hoppers 51 receive the supply of the toners from the toner cartridges 28 and supply the toners stored in the sub-hoppers 51 to the developing devices 28. Therefore, even if the toners in the toner cartridges 28 are exhausted, it is possible to perform printing using the toners in the sub-hoppers 51. It is possible to replace the toner cartridges 28 during the operation of the printer unit 17.

The sub-hoppers 51Y, 51M, 51C, and 51K are attached to a coupling member 52 and configure an integral unit. The unit configured by integrating the sub-hoppers 51Y, 51M, 51C, and 51K using the coupling member 52 is referred to as coupled hopper 53 below.

Figure 4:
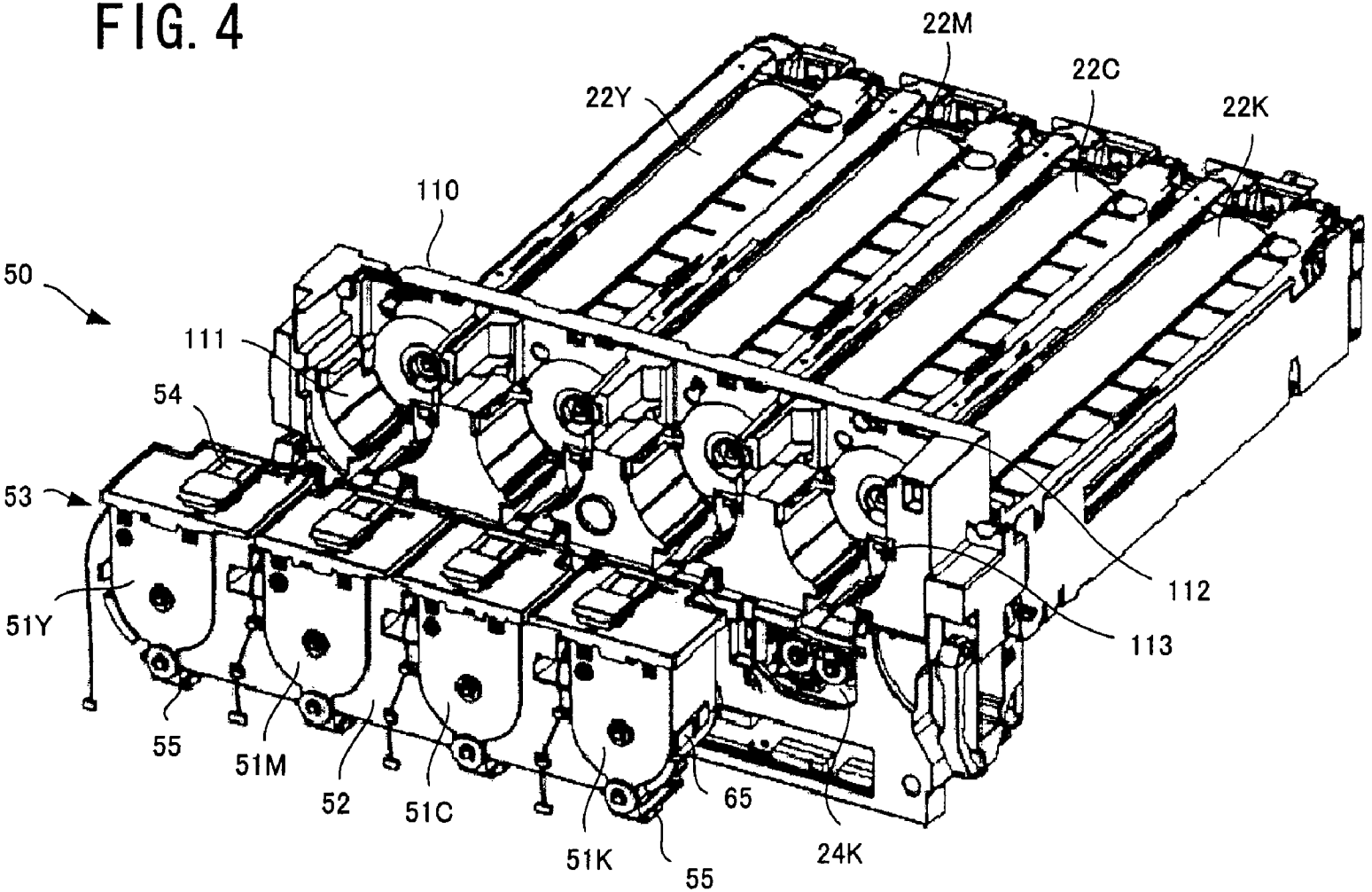
FIG. 4 is a disassembled perspective view showing the structure of sub-hoppers of the toner supplying apparatus.

FIG. 4 is a perspective view for explaining the coupled hopper 53 in detail. A state in which the coupled hopper 53 is removed from the main body unit is shown in FIG. 4. In the coupled hopper 53, the sub-hoppers 51Y, 51M, 51C, and 51K are attached to the coupling member 52.

The coupled hopper 53 can be detachably attached to a frame 110 provided in an upper stage of the developing devices 24. The frame 110 configures a holding member that detachably holds the sub-hoppers 51Y, 51M, 51C, and 51K. The frame 110 has recesses 111 in which the sub-hoppers 51Y, 51M, 51C, and 51K are housed, respectively.

The sub-hoppers 51 have toner receiving ports 54 on upper surfaces thereof. The toners supplied from the toner cartridges 28Y, 28M, 28C, and 28K are stored in the sub-hoppers 51 via the receiving ports 54. Discharge ports 55 are provided at lower ends of the sub-hoppers 51. The toners in the sub-hoppers 51 are supplied to the developing devices 24 via the discharge ports 55. Agitating devices (described later) that agitate the stored toners are provided in the sub-hoppers 51.

Figure 5:
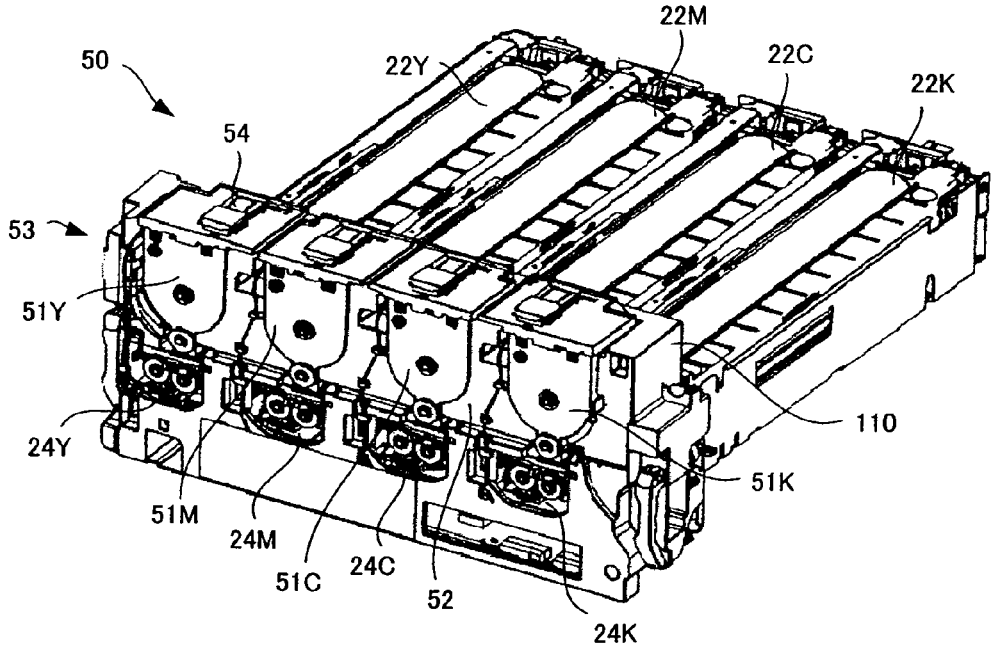
FIG. 5 is a perspective view showing a state in which the sub-hoppers are attached to a main body unit.
Figure 6:
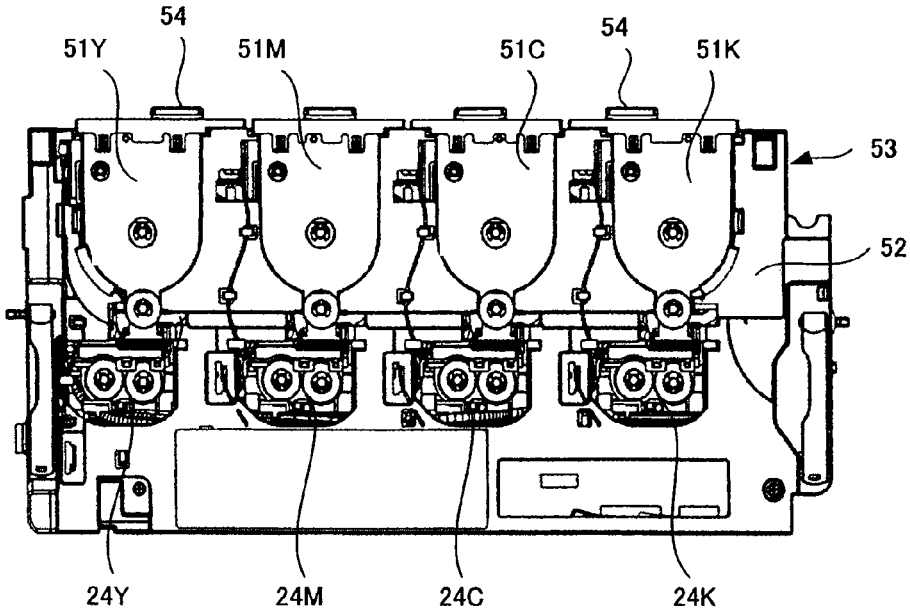
FIG. 6 is a front view showing the state in which the sub-hoppers are attached to the main body unit.

FIG. 5 is a perspective view of a state in which the coupled hopper 53 is attached to the frame 110. FIG. 6 is a front view of the state in which the coupled hopper 53 is attached to the frame 110.

When the coupled hopper 53 is held in the frame 110, the toners of the respective colors can be supplied from the sub-hoppers 51Y, 51M, 51C, and 51K to the developing devices 24Y, 24M, 24C, and 24K, respectively. Therefore, when the toner cartridges 28 are replaced, since the toners in the sub-hoppers 51 can be supplied to the developing devices 24, it is possible to operate the printer unit 17 and continue printing while the toner cartridges 28 are replaced.

Figure 7A:
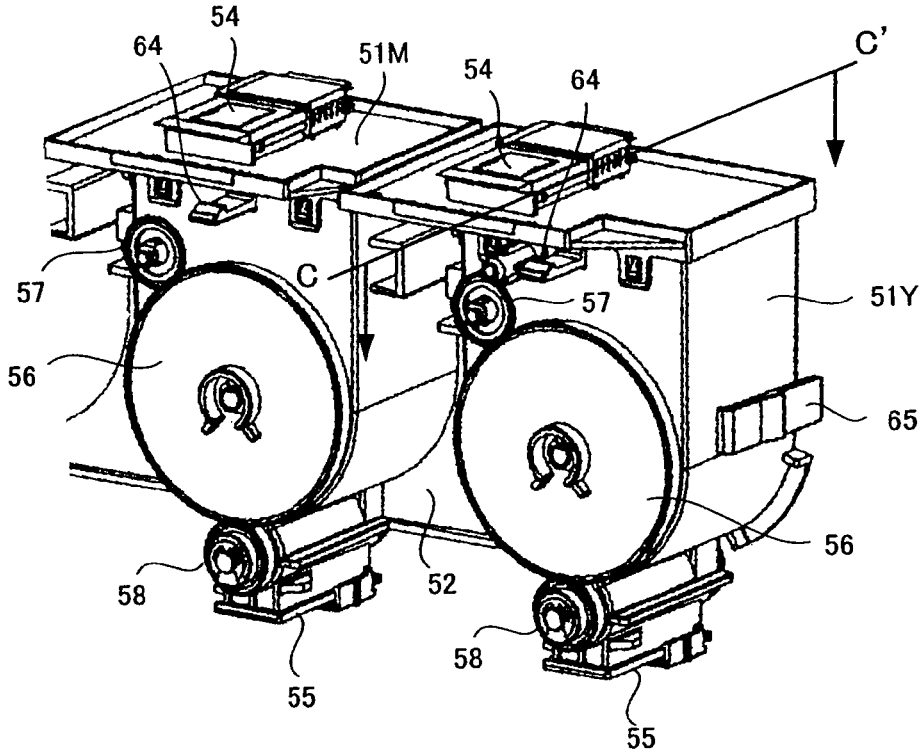
FIG. 7A is a perspective view of the sub-hoppers viewed from the back.
Figure 7B:
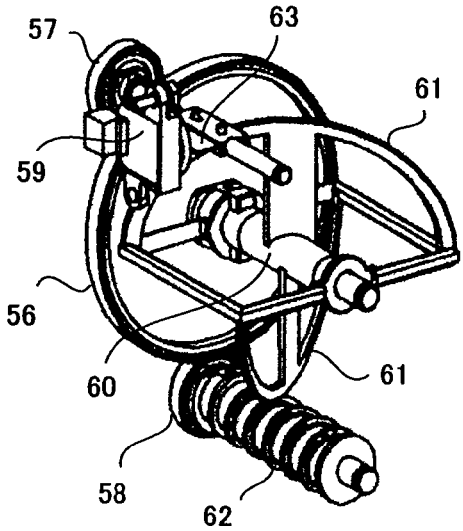
FIG. 7B is a perspective view showing the internal structure of the sub-hopper.
Figure 7C:
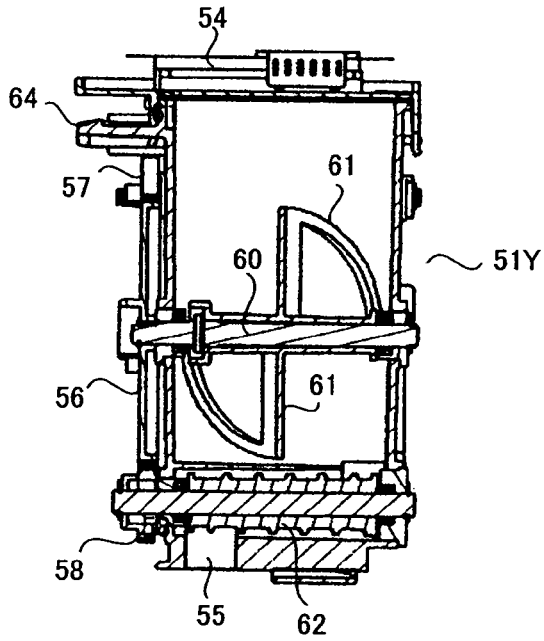
FIG. 7C is a sectional view taken along line C-C' in FIG. 7A.

FIGS. 7A, 7B, and 7C are diagrams showing the structure in the sub-hoppers 51.

FIG. 7A is a perspective view of the sub-hoppers 51 viewed from the back. Only the sub-hoppers 51Y and 51M are shown in the figure. A circular gear 56 having a large diameter is attached to the back of each of the sub-hoppers 51. Two gears 57 and 58 that mesh with the gear 56 and have a small diameter are provided.

The gear 56 has the coupling structure and is driven by a driving motor (not shown) provided in the main body, whereby the gear 57 rotates and the gear 58 also rotates.

FIG. 7B is a perspective view showing the structure in the sub-hopper 51. FIG. 7C is a sectional view taken along line C-C' in FIG. 7A.

As it is seen from FIG. 7B, a mixer 61 that agitates the toner is attached to a rotating shaft 60 of the gear 56. The mixer 61 rotates to agitate the toner in the sub-hopper 51. A screw 62 that carries the toner to the discharge port 55 is attached to the gear 58.

A toner sensor 59 is provided in the sub-hopper 51 and detects an upper surface of the toner in the sub-hopper 51. When the upper surface of the toner reaches the toner sensor 59, this indicates that the toner is stored in the sub-hopper 51. When the upper surface of the toner does not reach the toner sensor 59, this indicates that the toner is not stored in the sub-hopper 51. A quantity of the toner is controlled such that the upper surface of the toner is always in the position of the toner sensor 59.

Since a piezoelectric sensor is used as the toner sensor 59, it is necessary to always clean the surface (a detection surface) of the toner sensor 59. A blade 63 is attached to a rotating shaft of the gear 57 to clean the surface of the toner sensor 59.

The gear 58 is a one-way gear. When the gear 58 rotates in one direction (normally rotates), the screw 62 rotates and delivers the toner in the direction of the discharge port 55. When the gear 58 rotates in a reverse direction, torque is not transmitted to the screw 62.

When the toner is supplied from the sub-hopper 51 to the developing device 24, the driving motor of the sub-hopper 51 is normally rotated. When the toner is not supplied from the sub-hopper 51 to the developing device 24 but is supplied from the toner cartridge 28 to only the sub-hopper 51, it is possible to supply the toner to the sub-hopper 51 without supplying the toner to the developing device 24 by reversely rotating the driving motor.

As shown in FIG. 7A, pawl members 64 having elasticity that project in a direction of the frame 110 are provided on the back of the sub-hoppers 51. On the other hand, slits 112 (see FIG. 4) are formed in positions opposed to the pawl members 64 in the frame 110 such that the pawl members 64 fit in the slits 112 when the sub-hoppers 51 are attached to the frame 110.

Pawl members 65 having elasticity are provided on sides of the sub-hoppers 51Y and 51K located at ends of the coupled hopper 53. Grooves 113 (see FIG. 4) are formed in positions opposed to the pawl members 65 in the frame 110 such that the pawl members 65 fit in the grooves 113 when the sub-hoppers 51 are attached to the frame 110. Therefore, when the coupled hopper 53 is attached to the frame 110, the coupled hopper 53 can be attached with one touch of a finger.

On the other hand, in the image forming apparatus, it is necessary to feed developers into the developing devices 24 when the image forming apparatus is set up. Therefore, during the setup, the sub-hoppers 51 are once removed and developer cartridges are set in place of the sub-hoppers 51 to feed the developers into the developing devices 24.

Figure 8:
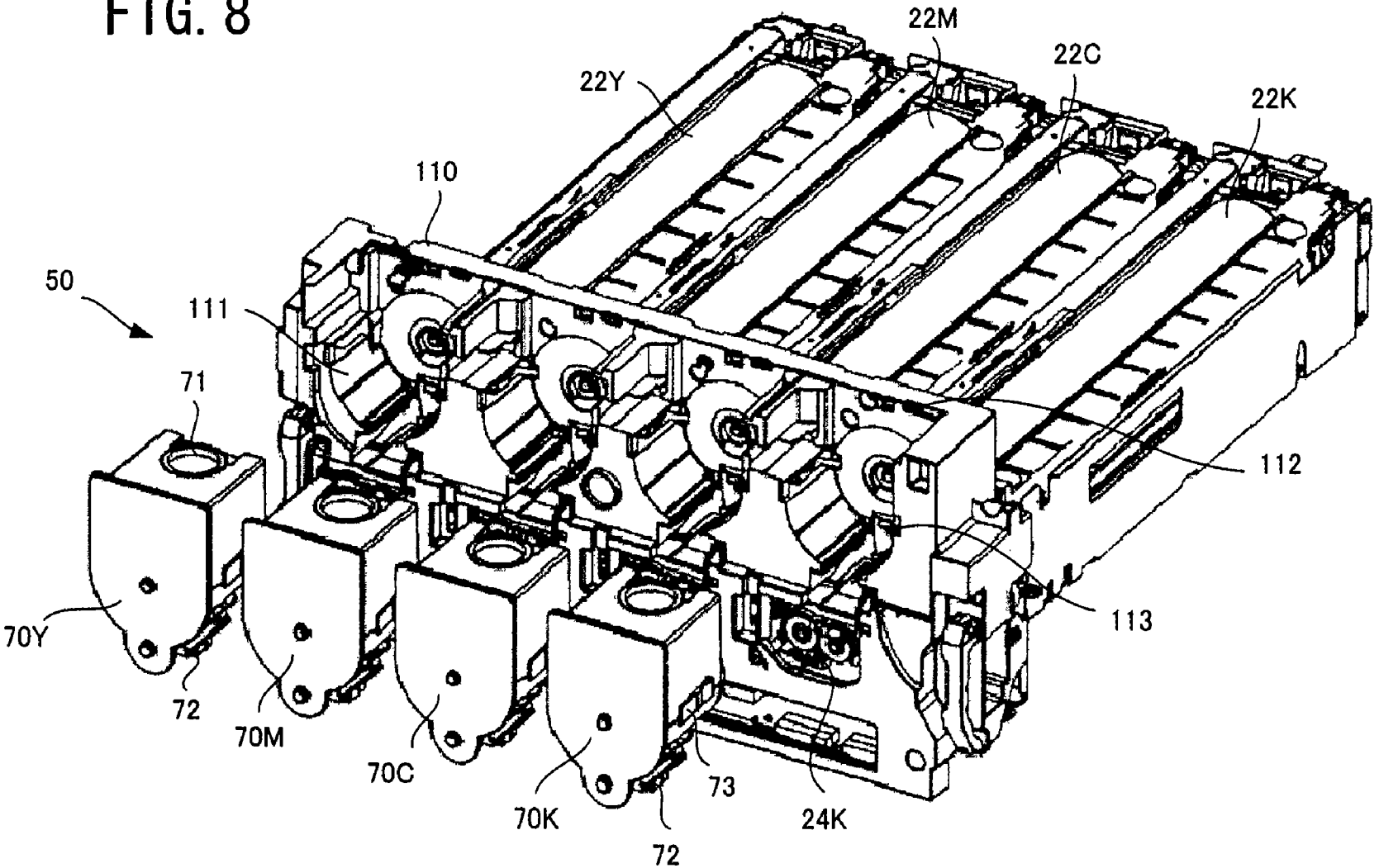
FIG. 8 is a perspective view showing developer cartridges according to the embodiment.

FIG. 8 is a perspective view of a state in which developer cartridges 70 are set in place of the sub-hoppers 51. When the developer cartridges 70 are set, the coupled hopper 53 is removed from the frame 110. The developer cartridges 70 include the developer cartridges 70Y, 70M, 70C, and 70K for the respective colors and have an external shape same as that of the sub-hoppers 51. Therefore, the developer cartridges 70Y, 70M, 70C, and 70K can be detachably held in the recesses 111 of the frame 110, respectively.

The developer cartridges 70Y, 70M, 70C, and 70K have developer injection ports 71 on upper surfaces thereof, respectively. The developer cartridges 70Y, 70M, 70C, and 70K have developer discharge ports 72 at lower ends thereof. The developers in the developer cartridges 70 can be supplied to the developing devices 24 via the discharge ports 72. Agitating devices (described later) that agitate the stored developers are provided in the developer cartridges 70.

Figure 9:
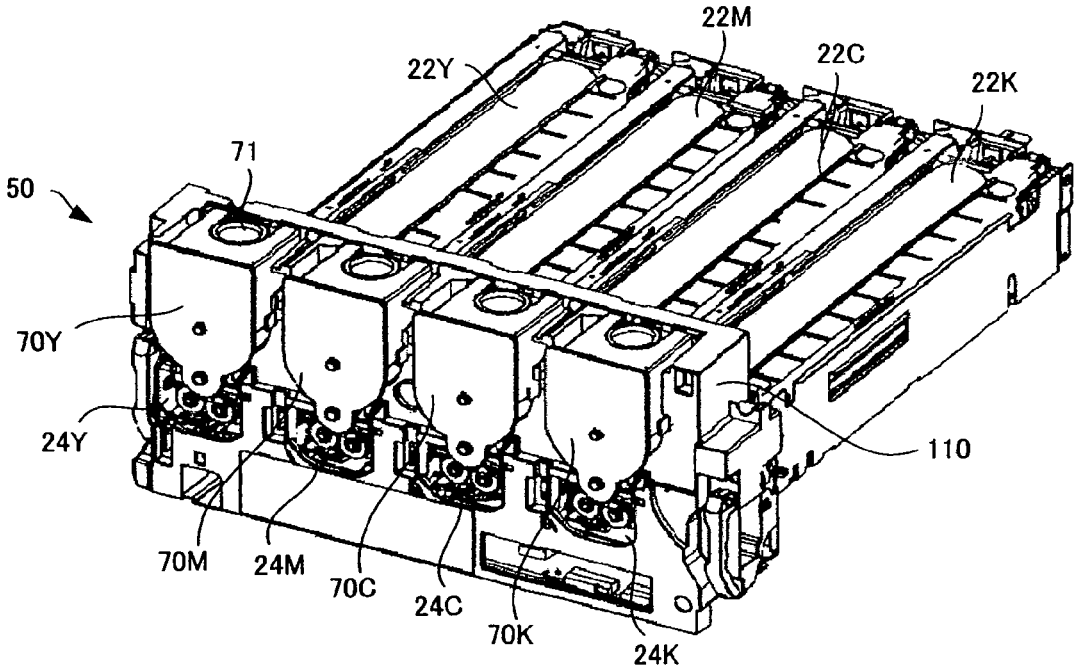
FIG. 9 is a perspective view showing a state in which the developer cartridges are attached to the main body unit.
Figure 10:
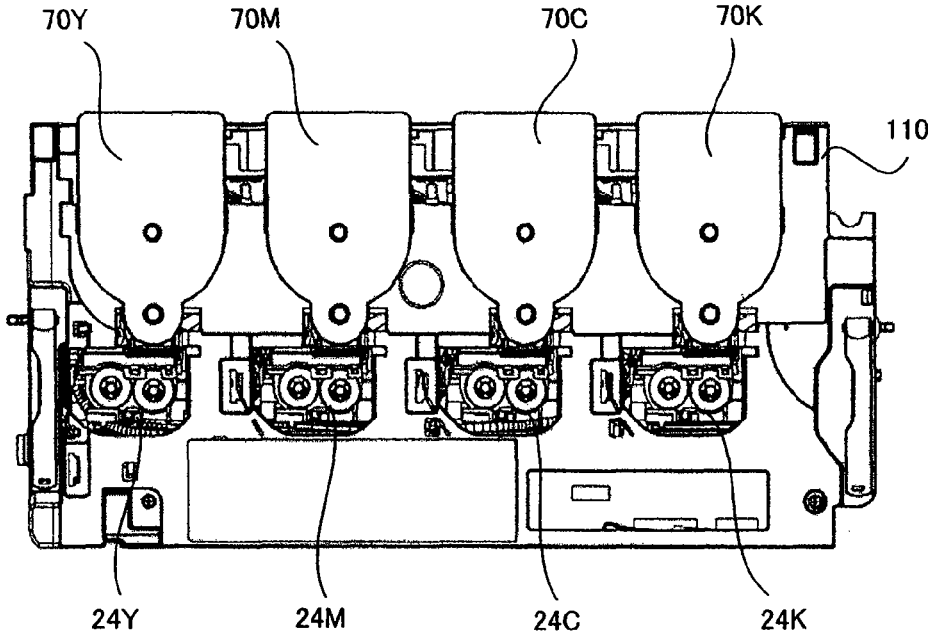
FIG. 10 is a front view showing the state in which the developer cartridges are attached to the main body unit.

FIG. 9 is a perspective view of a state in which the developer cartridges 70 are attached to the frame 110. FIG. 10 is a front view of the state in which the developer cartridges 70 are attached to the frame 110. When the developer cartridges 70 are attached to the frame 110, the developers can be supplied from the developer cartridges 70Y, 70M, 70C, and 70K to the developing devices 24Y, 24M, 24C, and 24K, respectively.

When the sub-hoppers 51 are attached in place of the developer cartridges 70, the coupled hopper 53 only has to be attached. Therefore, when the sub-hoppers 51 are attached again after the setup, the sub-hoppers 51 for wrong colors are prevented from being attached.

Figure 11A:
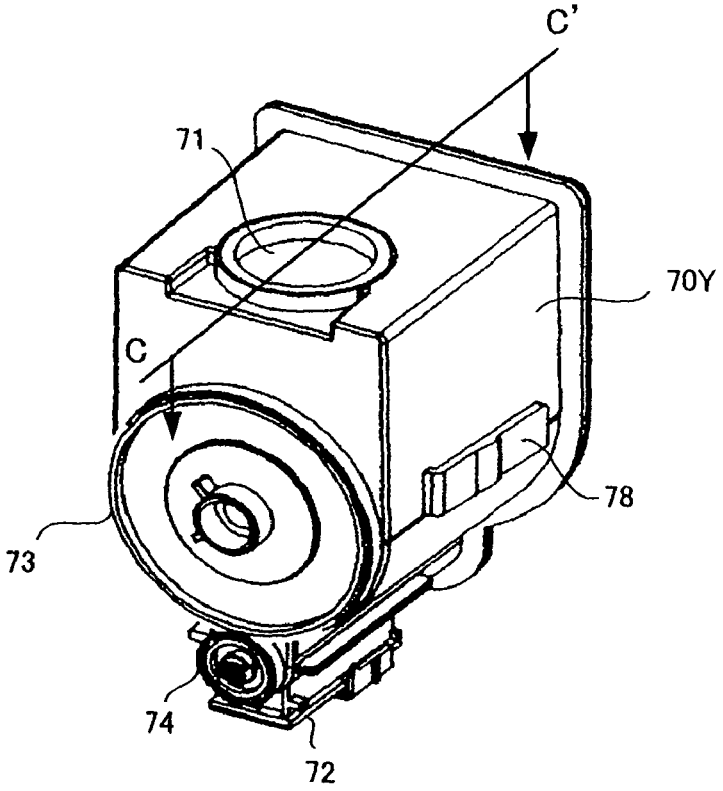
FIG. 11A is a perspective view of the developer cartridge viewed from the back.
Figure 11B:
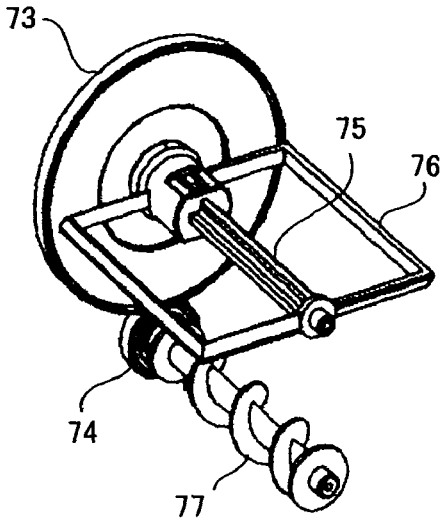
FIG. 11B is a perspective view showing the internal structure of the developer cartridge.
Figure 11C:
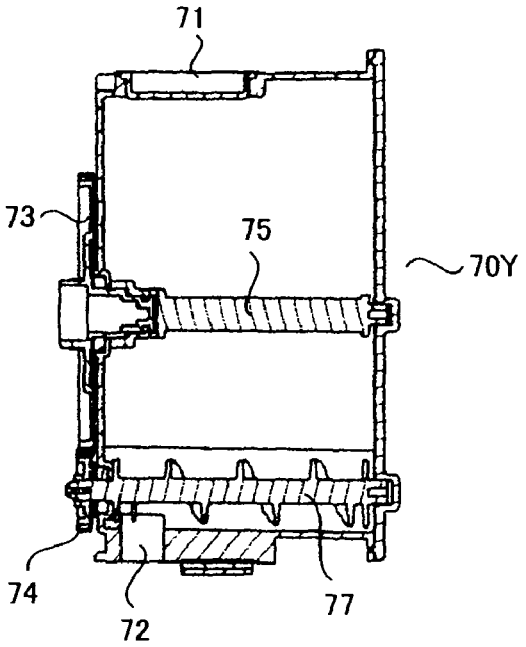
FIG. 11C is a sectional view taken along line C-C' in FIG. 11A.

FIGS. 11A, 11B, and 11C are diagrams showing the structure of the developer cartridge 70. FIG. 11A is a perspective view of the developer cartridge 70 viewed from the back. The developer cartridge 70Y is shown as an example. A circular gear 73 having a large diameter is attached to the back of the developer cartridge 70Y. A gear 74 having a small diameter that meshes with the gear 73 is provided. When the gear 73 is rotated by a motor (not shown), the gear 74 also rotates.

FIG. 11B is a perspective view of the structure in the developer cartridge 70. FIG. 11C is a sectional view taken along line C-C' in FIG. 11A.

As it is seen from FIG. 11B, a mixer 76 that agitates the developer is attached to a rotating shaft 75 of the gear 73. The mixer 76 rotates to agitate the developer in the developer cartridge 70.

A screw 77 that carries the developer to the discharge port 72 is attached to the gear 74. When the motor that rotates the gear 74 is set to rotate in one direction, the screw 77 rotates in one direction and can always deliver the developer to the discharge port 72.

A pawl member 78 having elasticity is provided on a side of the developer cartridge 70. On the other hand, the groove 113 is formed in a position opposed to the pawl member 78 in the frame 110 such that the pawl member 78 fits in the groove 113 when the developer cartridge 51 is attached to the frame 110. Therefore, when the developer cartridge 70 is attached to the frame 110, the developer cartridge 70 can be attached with one touch of a finger. The pawl member 78 and the groove 113 configure a one-touch attachment mechanism.

According to the embodiment described above, even if the toners in the toner cartridges 28 are exhausted, it is possible to perform printing using the toners in the sub-hoppers 51. It is possible to replace the toner cartridges 28 during the operation of the printer unit 17.

When the developers are fed into the developing devices 24 during the setup, the coupled hopper 53 only has to be removed and replaced with the developer cartridges 70. Therefore, work for feeding the developers during the setup is simplified.

Moreover, since the plural sub-hoppers 51 can be simultaneously removed by removing the coupled hopper 53, workability is improved. When the sub-hoppers 51 are attached again, the integrated coupled hopper 53 only has to be attached. Therefore, the sub-hoppers 51 for wrong colors are not set. The sub-hoppers 51 can be replaced in short time.

The present invention is not limited to the embodiment described above. Various modifications of the embodiment are possible. For example, in the example explained in the embodiment, the toner cartridges for the four colors Y, M, C, and K are used as the toner cartridges 28. However, the toner cartridges 28 may be plural toner cartridges for colors other than the four colors. In the embodiment, the system employing the intermediate transfer belt 21 is explained. However, a system not employing the intermediate transfer belt 21 may be adopted.

Although exemplary embodiments are shown and described, it will be apparent to those having ordinary skill in the art that a number of changes, modifications, or alterations as described herein may be made, none of which depart from the spirit. All such changes, modifications, and alterations should therefore be seen as within the scope.

What is claimed is:

1. An image forming apparatus comprising:

a plurality of developing devices that develop electrostatic latent images formed on image bearing members;

a plurality of toner cartridges in which toners to be supplied to the plurality of developing devices are stored;

a coupled hopper assembly including a plurality of sub-hoppers that receive the toners stored in the plural toner cartridges and supply the toners to the plurality of developing devices, and a coupling member that integrates the plurality of sub-hoppers;

a frame to which the coupled hopper assembly is detachably attached;

elastic pawl members provided on the coupled hopper assembly; and grooves formed in positions opposed to the pawl members in the frame, such that the pawl members fit in the grooves.

2. The apparatus of claim 1, wherein the coupled hopper assembly is arranged above the plurality of developing devices, and the plurality of toner cartridges are arranged above the coupled hopper assembly.

3. The apparatus of claim 2, wherein the plurality of sub-hoppers each having a receiving port in upper surfaces thereof for receiving the toners from the plurality of toner cartridges, and each having a discharge port at lower ends thereof for supplying the toners to the plurality of developing devices.

4. The apparatus of claim 3, wherein the plurality of sub-hoppers each include:

mixers that agitate the stored toners; and screws rotating in a single direction that carry the toners to the corresponding plurality of developing devices.

5. The apparatus of claim 4, wherein the mixers are attached to rotating shafts of gears that can normally and reversely rotate, and the screws are driven by one-way gears that rotate when the gear rotate in one direction and stop the rotation when the gears rotate in a reverse direction.

6. A toner supplying apparatus comprising:

a coupled hopper assembly including plurality of sub-hoppers that are provided in association with a plurality of toner cartridges and a plurality of developing devices, the plurality of sub-hoppers configured to receive a supply of toners from the respective plurality of toner cartridges, and to supply the supplied toners to the respective plurality of developing devices, the plurality of sub-hoppers integrated together using a coupling member;

a frame to which the coupled hopper assembly is detachably attached;

elastic pawl members provided on the coupled hopper assembly; and grooves formed in positions opposed to the pawl members in the frame, such that the pawl members fit in the grooves.

7. The apparatus of claim 6, further comprising a plurality of developer cartridges which store developers to be supplied to the plurality of developing devices, wherein the plurality of developer cartridges are configured to be detachably attached to the frame in place of the plurality of sub-hoppers.

8. The apparatus of claim 6, wherein the plurality of sub-hoppers have receiving ports in upper surfaces thereof for receiving the toners from the plurality of toner cartridges, and have discharge ports at lower ends thereof for supplying the toners to the plurality of developing devices.

9. The apparatus of claim 6, wherein the plurality of sub-hoppers include:

mixers that agitate the stored toners; and screws rotating in a single direction that carry the toners to the plurality of developing devices.

10. The apparatus of claim 9, wherein the mixers are attached to rotating shafts of gears that can normally and reversely rotate, and the screws are driven by one-way gears that rotate when the gear rotate in one direction and stop the rotation when the gears rotate in a reverse direction.

11. The apparatus of claim 7, wherein the plurality of developer cartridges each have an external shape same as that of the plurality of sub-hoppers, developer injection ports in upper surfaces thereof, and discharge ports at lower ends thereof for supplying the developers to the plurality of developing devices.

12. The apparatus of claim 7, wherein elastic members for detachably attaching the plurality of developer cartridges to the frame are formed in the plurality of developer cartridges.

13. A toner supplying method for an image forming apparatus, comprising:

detachably attaching a coupled hopper assembly to a frame, the coupled hopper assembly configured to integrate a plurality of sub-hoppers using a coupling member;

receiving a supply of toners from a plurality of toner cartridges to the plurality of sub-hoppers;

supplying the toners from the plurality of sub-hoppers to a plurality of developing devices; and providing elastic pawl members on the coupled hopper assembly, the pawl members fitting in grooves formed in positions in the frame opposed to the pawl members.

14. The method of claim 13, wherein the frame is provided above the plurality of developing devices and below the plurality of toner cartridges.

* * * * *